United States Patent [19]

Honegger et al.

[11] Patent Number: 5,042,792

[45] Date of Patent: Aug. 27, 1991

[54] PROCESS AND APPARATUS FOR THE CONVEYING OF PRINTING PRODUCTS

[75] Inventors: Werner Honegger, Tann Ruti; Walter Reist, Hinwil, both of Switzerland

[73] Assignee: Ferag AG, Hinwil, Switzerland

[21] Appl. No.: 436,330

[22] Filed: Nov. 13, 1989

[30] Foreign Application Priority Data

Nov. 11, 1988 [CH] Switzerland ..... 04202/88

[51] Int. Cl.[5] ..... B65H 29/70

[52] U.S. Cl. ..... 271/188; 271/182; 271/308; 271/216

[58] Field of Search ..... 271/69, 182, 188, 202, 271/209, 216, 307, 308

[56] References Cited

U.S. PATENT DOCUMENTS

| | | | |
|---|---|---|---|
| 3,044,772 | 7/1962 | Trenner | 271/188 |
| 3,160,413 | 12/1964 | Faeber | 271/209 |
| 4,445,681 | 5/1984 | Reist | 271/307 |
| 4,531,343 | 7/1985 | Wood | 271/188 |
| 4,618,136 | 10/1986 | Pessina et al. | 271/188 |
| 4,652,197 | 3/1987 | Littleton | 271/188 |
| 4,898,373 | 2/1990 | Newsome | 271/188 |
| 4,911,421 | 3/1990 | Hannon | 271/188 |
| 4,934,687 | 6/1990 | Hayden | 271/209 |

FOREIGN PATENT DOCUMENTS

| | | |
|---|---|---|
| 0075121 | 3/1983 | European Pat. Off. . |
| 0254851 | 2/1988 | European Pat. Off. . |
| 2183512 | 12/1973 | France . |
| 2247406 | 5/1975 | France . |
| 630583 | 6/1982 | Switzerland . |

*Primary Examiner*—Robert P. Olszewski
*Assistant Examiner*—Steve Reiss
*Attorney, Agent, or Firm*—Fleit, Jacobson, Cohn, Price, Holman & Stern

[57] ABSTRACT

A conveying apparatus delivers a succession of printing products in a first imbricated formation to a take-over region where the products are transferred to a delivery conveyor and conveyed away in a second imbricated formation. In the takeover region, the successive products are formed into an arched configuration, when viewed perpendicularly to the direction of their travel. This assists in ensuring that the products are delivered singly to the delivery conveyor even if the products are received at the takeover region in congruent fully overlapping pairs.

33 Claims, 8 Drawing Sheets

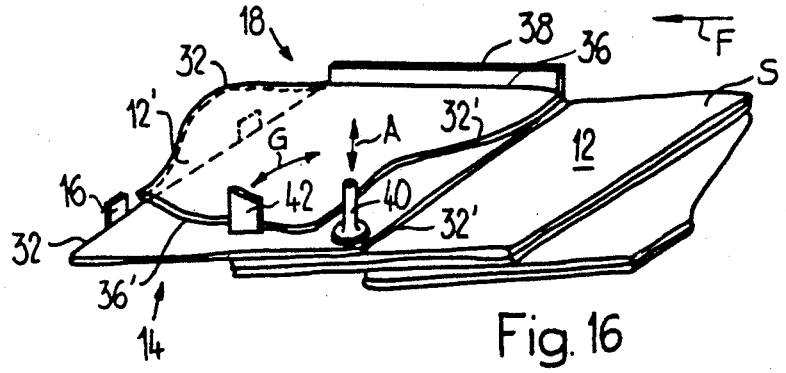
Fig. 16
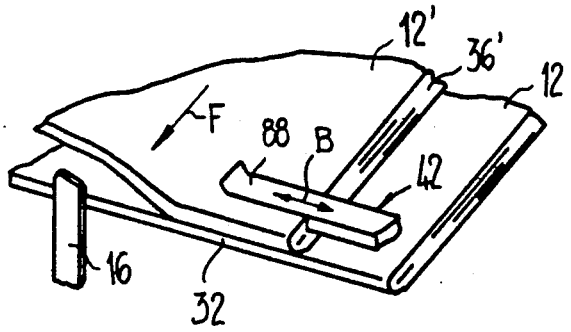
Fig. 17
Fig. 18
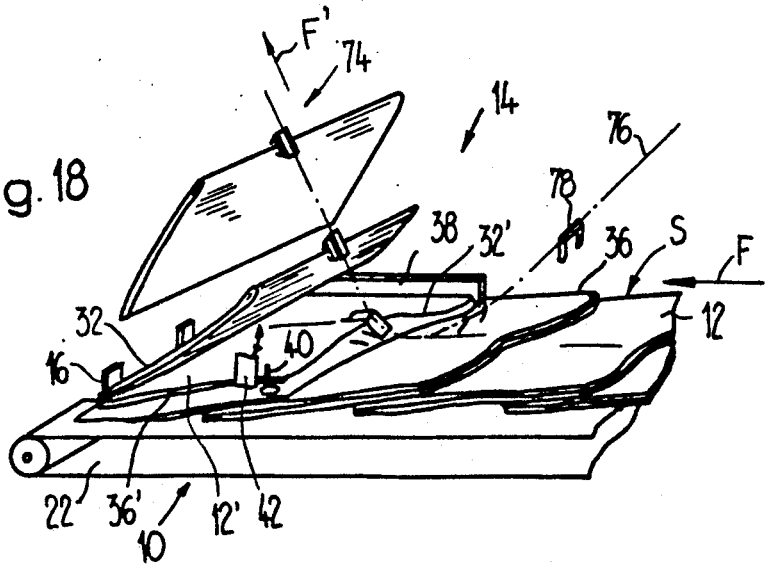

PROCESS AND APPARATUS FOR THE CONVEYING OF PRINTING PRODUCTS

BACKGROUND OF THE INVENTION

The present invention relates to a process and an apparatus for the conveying of printing products in an imbricated formation.

Such an apparatus is known, for example, from Swiss Patent Specification 630,583 and the corresponding U.S. Pat. No. 4,320,894. In the imbricated formation fed by means of a conveying device to a takeover region, each printing product rests on the succeeding one. The leading edges of the printing products are consequently overlapped by the preceding printing product. The conveying device transports the printing products essentially in horizontal direction, while the conveying direction of the removal conveyor in the takeover region runs from down to up. The removal conveyor has individually controllable grippers, which are arranged on a drawing member and, in the takeover region, grip the printing products fed by the feed conveyor at the leading edges and raise them up from the imbricated formation. The imbricated formation is consequently peeled off. If, in the case of the known apparatus, the conveying rate of the removal conveyor is half as great as the conveying rate of the conveying device, in each case two printing products, lying one on top of the other, come into the engagement of a gripper, so that in each case two printing products, lying one on top of the other, are lifted off with each other. Consequently, in the case of this known apparatus, in the case of fed imbricated formations in which a single printing product rests in each case on the succeeding one, either each individual printing product is taken up by a gripper and peeled off from the imbricated formation, or two printing products are pushed one over the other, so that each gripper grips and carries away two printing products lying one on top of the other.

It is the object of the present invention to propose a process and to provide an apparatus for the conveying of printing products with which printing products fed in the widest variety of formations can be conveyed further individually or in formations in which in each case only a single printing product rests on the other.

SUMMARY OF THE INVENTION

In accordance with the invention printing products are conveyed with their leading edges against a stop, and the respectively uppermost printing product up against the stop is arched in a region of the leading or trailing edge. As a result, the prerequisites are created for a removal conveyor to convey the printing products away singly, irrespective of the formation in which the printing products are fed. Thus, imbricated formations can be processed in which the leading edges of the printing products are in each case covered by the preceding printing product, and in which the printing products are arranged irregularly or with two or more printing products lie fully overlapping one on top of the other. Furthermore, in the process according to the invention and the corresponding apparatus, printing products can be processed which are fed to the takeover region in packs of several printing products lying one on top of the other.

In a preferred way, the region in which the arching is to be performed is predetermined or given in advance for the printing products. This takes place in a preferred way by corresponding precurving of the printing products. If, before they are fed to the takeover region, the printing products are unwound from a roll, on which they are wound together with a winding band under tensile stress, the different contact pressure of the printing products in the region of the winding band and outside this winding band can predetermine or impress on the printing products the region in which the later arching takes place.

Further preferred features of the process and exemplary embodiments of the apparatus are specified in the further dependent claims.

BRIEF DESCRIPTION OF DRAWINGS

The present invention is explained in more detail below with reference to the drawing, in which, purely diagrammatically:

FIGS. 16 and 17 show two further embodiments of an arching device, FIG. 18 shows an embodiment of the apparatus, in which the printing products are taken up at their edges and carried away.

DESCRIPTION OF THE PREFERRED EMBODIMENTS

Figure 1:
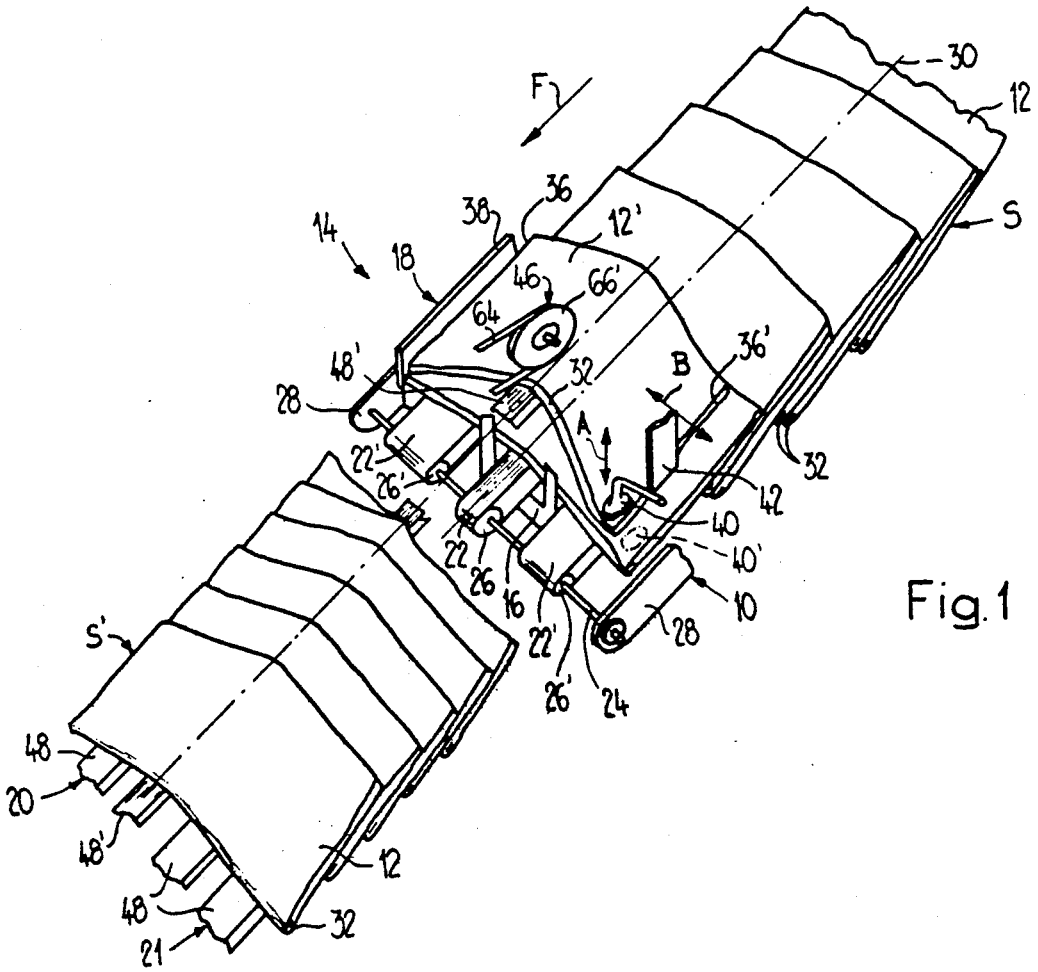
FIG. 1 shows a first embodiment of the apparatus, represented perspectively and partially interrupted.

The apparatus represented in FIGS. 1 to 6 has a conveying device 10 for the feeding of printing products 12 to a takeover region 14, a stop 16 provided in the takeover region 14, and an arching device 18, likewise arranged in the takeover region 14, as well as a removal conveyor 20, downstream of the conveying device 10, seen in conveying direction F. For the sake of better clarity, the arching device 18 is not represented in FIGS. 2 to 4 and 6.

The conveying device 10 is designed as a belt conveyor which has central conveyor belt 22 and outer conveyor belts 22', which are spaced laterally apart and revolvingly driven parallel to one another in conveying direction F. These conveyor belts 22, 22' are led at the beginning and end of the conveying section of the conveying device 10 around the deflection rolls 26, 26', seated on common shafts 24. The bearing plates for the shaft 24 are denoted in FIG. 1 by 28. In the figures, the beginning region of the conveying section is not represented. The drive of the conveying device 10 is performed in a known way via a chain drive, not represented in the figures. The diameter of the two outer deflection rolls 26' is less than the diameter of the deflection roll 26 seated in the center on the shaft 24. Since, at the beginning region of the conveying section, all three conveyor belts 22, 22' are led around deflection rolls of the same size, this has the result that the conveying sides of the two lateral conveyor belts 22' run downward, seen in conveying direction F, in relation to the conveying side of the central conveying belt 22. This has the consequence that, during the feeding toward the takeover region 14, the printing products 12 resting on the conveyor belts 22, 22' are precurved in the form of a ridged roof denoted by 30 and represented by a dot-dashed line (see FIG. 1 in particular).

Figure 2:
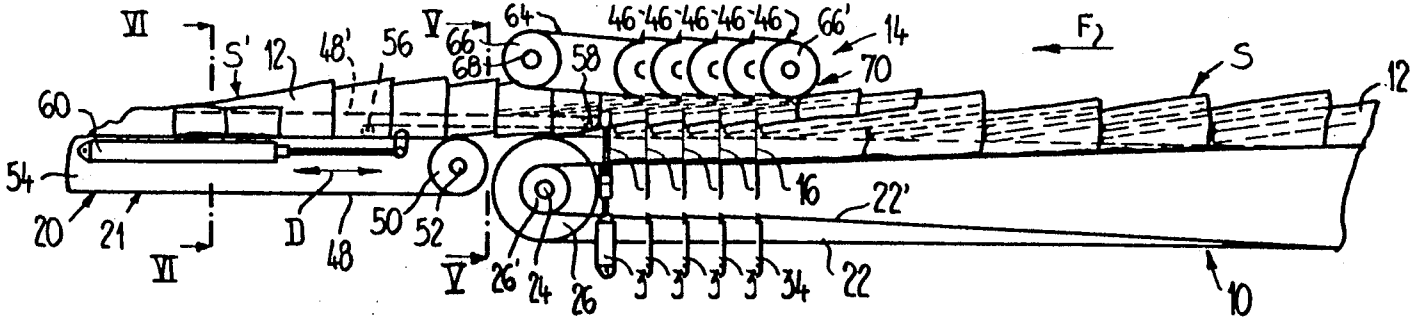
FIGS. 2 to 4 show the same embodiment as in FIG. 1, in side view and partially in section, at various instants of a working cycle or in different operating modes.
Figure 3:
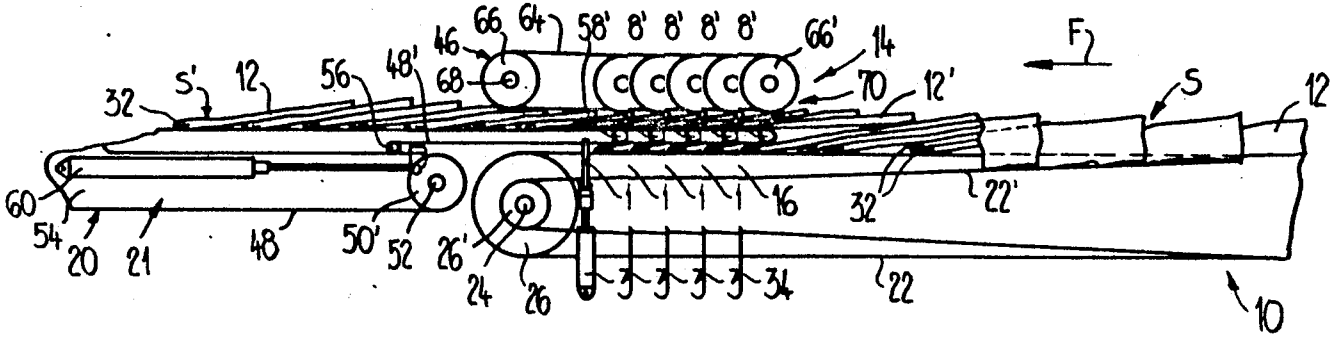

The printing products 12 shown in FIGS. 1 to 3, resting on the conveyor belts 22, 22' of the conveying device 10, are arranged in an imbricated formation S in which two printing products 12 in each case rest congruently one on top of the other, and this pair of products themselves lie on a pair of adjacent printing products 12 likewise lying congruently one on top of the other, so that the leading edges 32 of each pair of the printing products 12 are in each case covered by the preceding pair of printing products 12.

The stop 16 is designed in the form of a fork and embraces from below the central conveyor belt 22. By means of a cylinder-piston unit 34, the stop 16 can be brought from a stop position, shown in FIGS. 1 to 3 and 5, in which it projects beyond the carrying side of the central conveying belt 22, into a rest position, shown in FIG. 4 and denoted by 16', in which its free end is arranged underneath the conveying side of the conveyor belts 22.

Figure 5:
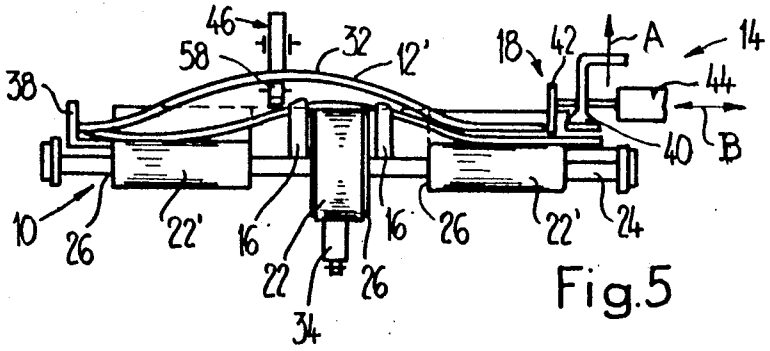
FIGS. 5 and 6 show vertical sections along the line V—V and VI—VI respectively of FIG. 2.
Figure 6:
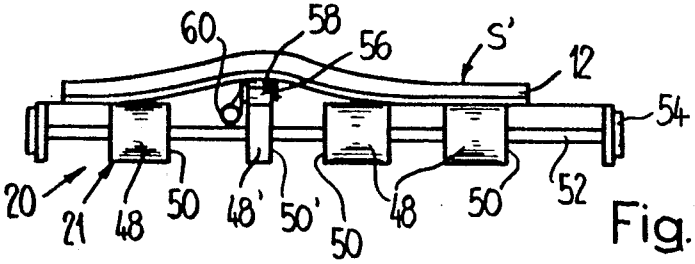

The arching device 18, arranged in the takeover region 14, has a stop element 38, arranged in the region of the right-hand side edges 36, seen in conveying direction F, of the printing products 12, and a raising element 40 and a slide element 42, arranged in the region of the left-hand side edges 36' of the printing products 12, as is represented in FIGS. 1 and 5. The stop element 38 is an angle-profile piece, fastened on the bearing plate 28, the longitudinal axis of which piece runs parallel to the conveying direction F and against the vertical leg of which piece the printing product 12' respectively taken up by the slide element 42 comes into contact with its right-hand side edge 36 (FIG. 5).

The raising element 40 is designed as a suction bell which can be connected periodically to a vacuum source (not shown) and can be raised and lowered (double-headed arrow A) in vertical direction by means of a drive arrangement (likewise not shown). The slide arrangement 42 can be displaced back and forth (double-headed arrow B) in horizontal direction and at right angles to the conveying direction F toward the stop element 38 by means of a further cylinder-piston unit 44, only shown in FIG. 5.

Figures 8, 9, 10, 11:
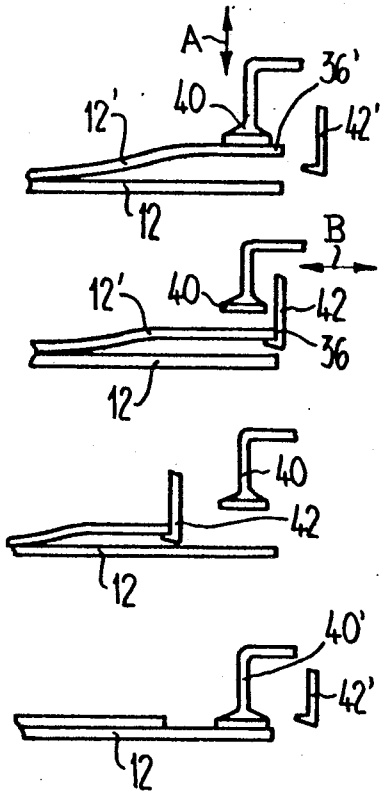

The operating principle of the raising element 40 and slide element 42 is represented enlarged in FIGS. 8 to 11. The same parts are provided with the same reference symbols as in FIGS. 1 and 5. The raising element 40 is lowered from above in arrow direction A onto the uppermost printing product 12' of a pair up aginst the stop 16 in the region of the left-hand side edge 36' of the said product and is connected to the vacuum source. Upon subsequent raising of the raising element 40, this printing product 12' is lifted in the region of the side edge 36' (FIG. 8). The slide element 42 is in its rest position, denoted by 42'. Subsequently the cross-sectionally angular slide element 42 is applied by means of the further cylinder-piston unit 44 in arrow direction B to the side edge 36' of the raised printing product 12' and the raising element 40 is uncoupled from the vacuum source. This has the consequence that the printing product 12' detaches from the raising element 40 and comes into contact with the region of its left side edge 36' on the leg of the slide element 42 running in approximately horizontal direction (FIG. 9). By the further moving of the slide element 42 in the direction of the stop element 38, the printing product 12' comes into contact with its right-hand side edge 36 against the stop element 38 and is then arched in the central region along the arching line 30 (compare in particular FIGS. 1, 5 and 10). As soon as the thus-arched printing product 12' is taken up by the removal conveyor 20, the slide element 42 is retracted into its rest position 42', as represented in FIG. 11. By renewed lowering of the raising element 40, the latter comes into contact on the lower printing product 12 still abutting the stop 16; this is indicated in FIG. 1 by 40'. Then the raising element 40 is again connected to the vacuum source and the cycle begins anew.

The removal conveyor 20 has a belt conveyor 21, downstream of the conveying device 10, seen in conveying direction F, and a pressing arrangement 46, arranged in the takeover region 14 above the fed printing products 12. The four conveyor belts 48, 48' of the belt conveyor 21, running parallel to one another, are led in a known way at the beginning and end around deflection rolls, only the beginning region being represented in FIGS. 1, 4 and 6. These deflection rolls are denoted by 50, 50' and are seated on a rotary shaft 52, which is arranged on a rocker 54, swivel-mounted in the end region of the belt conveyor 21. The rocker 54 is represented in its upper end position in FIGS. 1, 2 and 3 and in its lower end position, in the arrow direction C, in FIG. 4.

The right-hand conveyor belt 48', seen in conveying direction F, of the two central conveyor belts 48, 48' is arranged in that region in which the greatest arching of the printing product 12' arched by the arching device 18 takes place. This is approximately in the center between the stop element 38 and the slide element 42 of the arching device 18, extended fully in the direction of the stop element 38. This conveyor belt 48' runs with its upper side, in relation to the deflection roll 50', in the shape of an S around two deflection rollers 56, 58, (FIG. 2) which are mounted freely rotatably on a carriage, which can be displaced in arrow direction D by means of a piston-cylinder drive arrangement 60 and, which carriages, is not represented for the sake of better clarity. From the deflection roller 58, the carrying side of the conveyor belt 48' runs to the corresponding deflection roll in the end region of the conveying section of the belt conveyor 21. It should be noted that in FIG. 3 the printing products 12, 12' are represented partially in section and so this conveyor belt 48' with the deflection rollers 56, 58 is not covered. In FIG. 2, the carriage is in transporting position, in which the deflection rollers 58 are arranged in the region of the stop 16 but following the latter, seen in conveying direction F. In FIG. 3, the carriage is in a fetching position, denoted by 58', in which the deflection roller 58 is arranged upstream of the stop 16, seen in conveying direction F and in FIG. 4 the carriage is retracted into its rest position, denoted by 58'' in which the deflection roller 58 is arranged downstream of the deflection rolls 26, 26' of the conveying device 10, seen in conveying direction F, and, with the frame 54 lowered (arrow C), is approximately on the same level as the conveying side of the central conveyor belts 22 of the conveying device 10.

Figure 4:
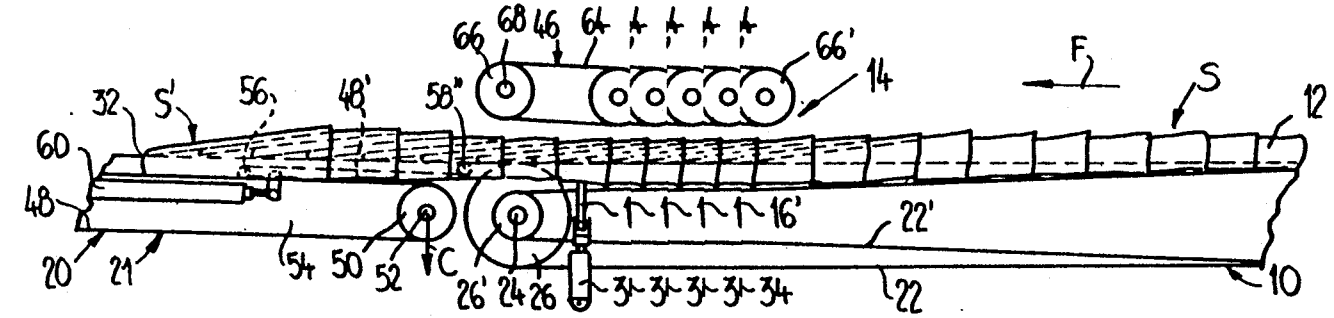

The pressing arrangement 46 is likewise designed as a belt conveyor, the single conveyor belt 64 of which is arranged above the conveyor belt 48' when the carriage is in the transporting position 58 and fetching position 58'. The conveyor belt 64 is led around two deflection rollers 66, 66', the deflection roller 66' arranged upstream of the deflection roller 66, seen in conveying direction F, being swivel-mounted about the axis of rotation 68 of the deflection roller 66 in the form of a weight lever. With the carriage in transporting position 58 and fetching position 58', the conveyor belt 64 and the conveyor belt 48' define a conveying nip 70 (FIGS. 2 and 3) for the printing products 12, 12' being transported away. The pressing arrangement 46 is shown in FIGS. 1–3 and 5 in the lower position, in which the lower, conveying side of the conveyor belt 64 is in contact with the printing products 12, 12', and is shown in FIG. 4 in the upper position, in which the pressing arrangement 46 is lifted off the printing products 12.

The printing products 12 are arranged on the conveyor belts 48, 48' of the belt conveyor 21 in an imbricated formation S', in which each printing product 12 rests on the succeeding printing product 12, seen in conveying direction F, so that each leading edge 32 is covered by the preceding printing products 12. The fed imbricated formation S represented in FIG. 4 corresponds to the imbricated formation S'.

The apparatus represented in FIGS. 1–3, 5 and 6 operates as follows. The printing products 12 are precurved in the region arranged upstream of the takeover region 14. Two printing products 12 lying congruently one on top of the other are in each case conveyed against the stop 16, against which they strike with their edges 32. Subsequently, the upper printing product 12' of these two printing products 12, 12' abutting the stop 16 are fully arched in the region of the pre-curving by means of the arching device 18, as has been described, the deflection roller 58 is in its transporting position (see FIG. 2 in particular). During arching of the printing product 12', the latter is placed, from below, with its leading edge 32, against the arched region of the preceding printing products 12, already taken up by the removal conveyor 20. By moving out the carriage with the deflection rollers 56, 58 against the conveying direction F into the fetching position, shown by 58', the arched printing product 12' is engaged underneath by the conveyor belt 48' and led into the conveying nip 70 (FIG. 3). As a result, the deflection roller 66' of the pressing arrangement 46 is raised slightly and the printing product 12' is pressed under the pressing force of the conveyor belt 64 in the conveying nip 70 against the conveyor belt 48' or against the preceding printing product 12, is securely taken up and conveyed away in conveying direction F. Subsequently, the deflection rollers 56, 58' are retracted in conveying direction F into the transporting position 58 (FIG. 2), and the single printing product 12 still up against the stop 16 is arched and conveyed in an analogous manner. During the time in which two printing products 12, 12' up against the stop 16 are in each case individually arched and conveyed away, the imbricated formation S is conveyed further in conveying direction toward the stop 16 at constant speed, so that the two next printing products 12 lying one on top of each other come into contact with the stop 16 as soon as the two preceding printing products 12, 12' have been conveyed away.

Consequently, from a fed imbricated formation S, in which two printing products lying congruently one on top of the other in each case rest on two succeeding printing products, likewise lying congruently one on top of the other, the printing products 12, 12' are carried away individually and in an imbricated formation S', in which each printing product 12 rests singly on the succeeding printing product 12.

Now if the mutual position of the printing products 12 is already correct in the fed imbricated formation S and does not need to be changed, the two deflection rollers 56, 58 are retracted into the rest position denoted by 58'' (FIG. 4), the removal conveyor 20 is lowered and the stop 16 is brought into the rest position 16'; at the same time, the pressing arrangement 46, in its lower end position, comes into contact on a stop, not represented, and consequently no longer rests on the printing products 12. In this operating mode, the mutual position of the printing products 12 is not changed, so the imbricated formation S' conveyed away corresponds to the fed imbricated formation S.

Figure 7:
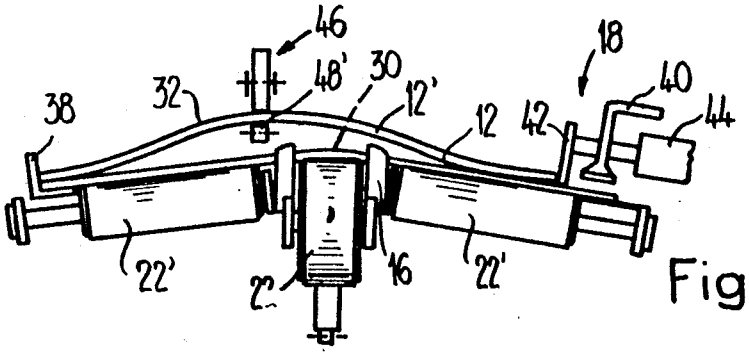
FIG. 7 shows a further embodiment of the apparatus, in the same representation as FIG. 5, FIGS. 8 to 11 diagrammatically show the raising and engaging underneath of the side edges for the arching of the printing products.

FIG. 7 corresponds to the view according to FIG. 5, but the conveying device for the precurving of the said printing products 12 is of a different design. The conveying device 10 represented in FIG. 7 likewise has 3 conveyor belts 22, 22', revolving essentially parallel to one another, but the carrying sides of the two lateral conveyor belts 22' are inclined outwardly and downward The printing products 12 thus arranged on the three conveyor belts 22, 22' are consequently precurved in the form of a ridged roof, the curving line 30 being in the region of the central conveyor belt 22. The arching device 18 is essentially of the same design as that described further above and represented in detail in FIGS. 1, 5 and 8 to 11. The stop element 38 runs with its lateral flank at right angles to the conveying side of the right-hand conveyor belt 22', seen in conveying direction F, the moving direction of the raising element 40 runs at right angles to the carrying side of the left-hand conveyor belt 22', seen in conveying direction F, and the slide element 42 is moved by means of the cylinder-piston unit 44 in a direction parallel to this carrying side. The printing product 12' arched by means of the arching device 18 is brought with the central region of the leading edge 32 into contact with the pressing arrangement 46 or with the preceding printing products 12, is engaged underneath by the conveyor belt 48' and conveyed away (compare FIGS. 1 to 3). The stop 16 is of the same design as in the embodiment of the conveying device 10 according to FIGS. 1 and 5 and embraces the central conveyor belt 22 from below.

Figure 12:
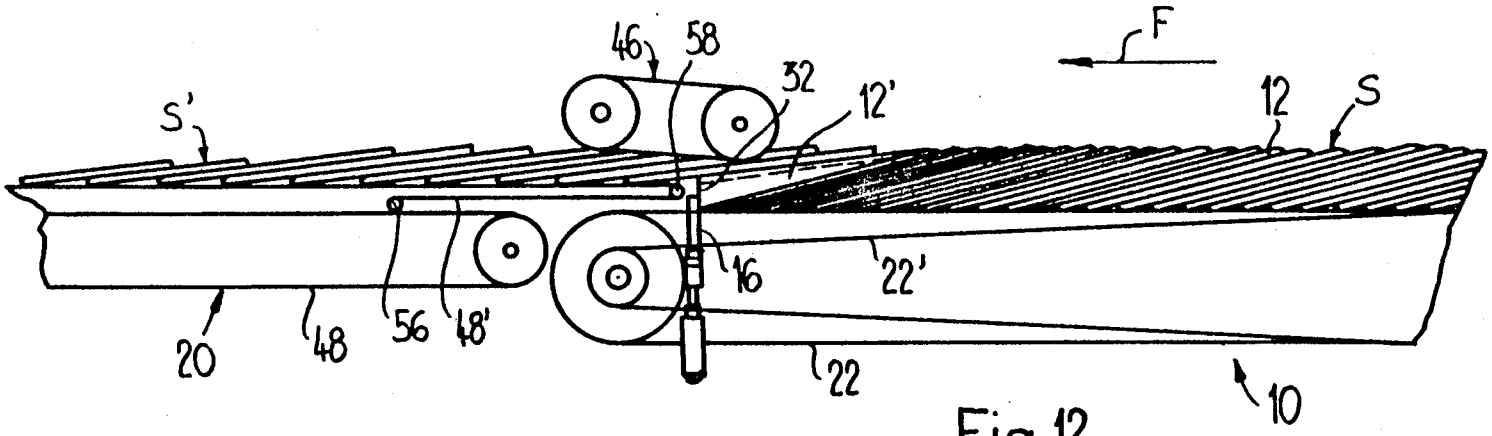
FIGS. 12 and 13 show the apparatus according to FIG. 2 and a further development, respectively, in the processing of printing products fed in the form of an imbricated buffer stack.

The apparatus represented in FIG. 12 is identical to the apparatus represented in FIGS. 1 to 6, it is therefore not described in any more detail. The printing products 12 arranged on the conveyor belts 22, 22' of the conveying device 10 are conveyed toward stop 16 in an imbricated formation S, in which each printing product 12 rests on the succeeding printing product 12 and each printing product 12 almost completely overlaps the neighboring printing product 12. This imbricated formation S has the form of an imbricated buffer stack. The respectively forwardmost printing product 12', with its leading edge 32 up against the stop 16, of this imbricated buffer stack is arched by means of the arching device 18, not represented in this figure (compare FIGS. 1, 5, 8 to 11), placed in the region of arching underneath the preceding printing product 12 taken up by the removal conveyor 20 and engaged underneath, in an analogous way to that described further above, by the conveyor belt 48', led around the deflection rollers 56 and 58, and conveyed away. Since the conveying speed of the conveyor belts 48, 48' and of the pressing arrangement 46 is greater than the conveying speed of the conveying device 10, out of the said imbricated buffer stack there is formed an imbricated formation S' in which each printing product 12 rests on the succeeding printing product 12, but the overlap of these printing products 12 is reduced.

Figure 13:
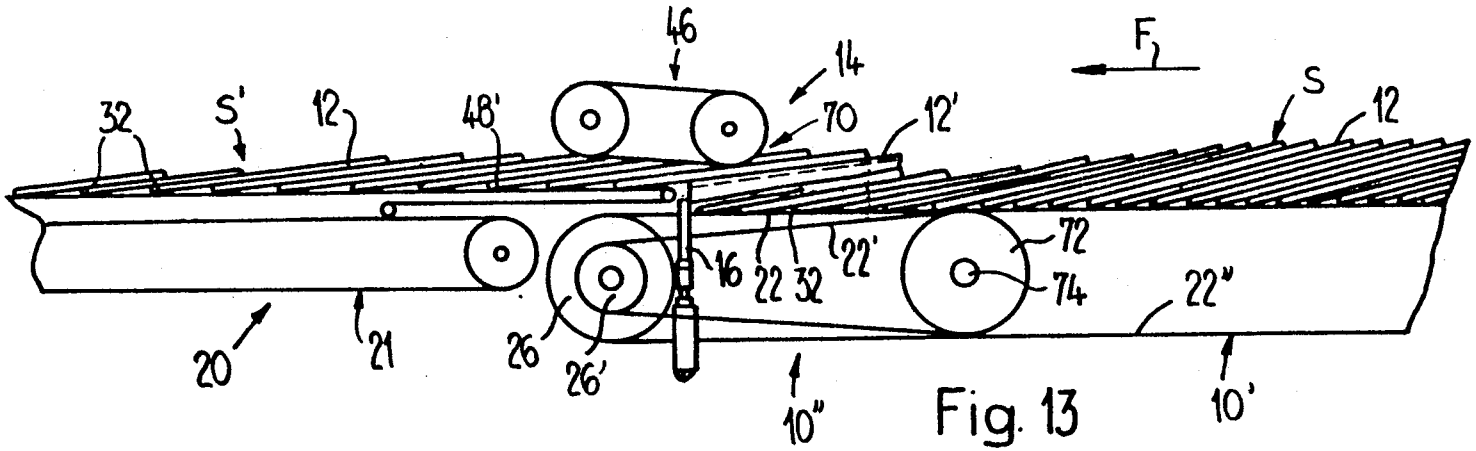

The apparatus represented in FIG. 13 corresponds essentially to the apparatus according to FIG. 12, but the conveying device 10 has two part-conveyors 10' and 10''. In a region arranged upstream of the takeover region 14, seen in conveying direction F, the conveyor belts 22, 22' of the first part-conveyor 10' are led around deflection rolls 72, which are seated on the shaft 74. Further deflection rolls, which cannot be seen in FIG. 13 and around which the conveyor belts 22, 22' of the second part-conveyor 10'' are led, are seated on this shaft 74. These conveyor belts 22, 22' are led around the deflection rolls 26, 26' in the takeover region 14 in an analogous way to that represented in FIG. 1 or 12. On the first part-conveyor 10', the printing products 12 lie in an imbricated formation S in which they form an imbricated buffer stack similar to in FIG. 12. As soon as the printing products 12 of this imbricated buffer stack arrive in the region of the second part-conveyor 10'' they are accelerated and the mutual overlap of two abutting printing products 12 is reduced, since the conveying speed of the second part-conveyor 10'' is greater than the conveying speed of the first part-conveyor 10''. The printing products 12 of the imbricated buffer stack, arranged on the conveyor belts 22, 22' of the second part-conveyor 10'', are precurved and conveyed with their leading edges 32 toward the stop 16. The respectively forwardmost printing product 12' up against the stop 16 is arched by means of the arching device 18, not represented, engaged underneath by the conveyor belt 48' and thus introduced into the conveying nip 70 between the pressing arrangement 46 and the belt conveyor 21 and conveyed away. In the case of this apparatus as well, from the printing products 12 fed in the form of an imbricated buffer stack there is formed an imbricated formation S', in which each printing product 12 rests on the succeeding one and which has an overlap precisely given in advance or a spacing precisely given in advance between the leading edges 32 of two neighboring printing products 12.

Figure 14:
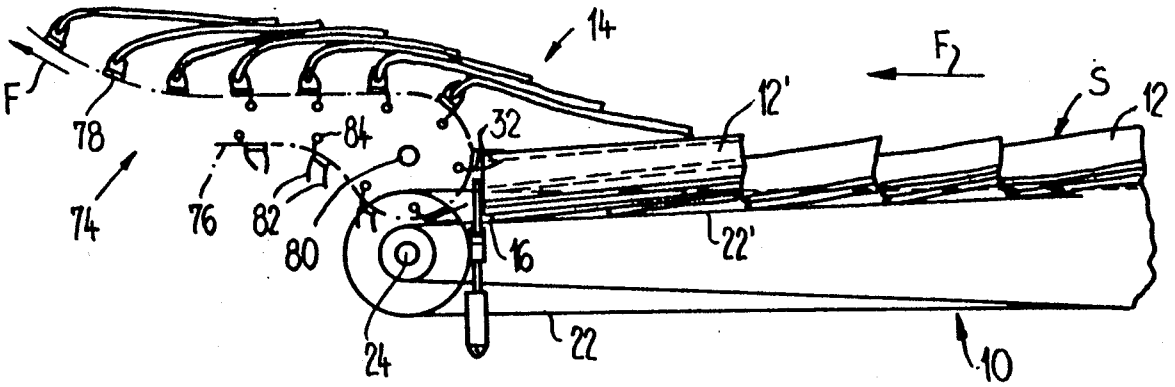
FIGS. 14 and 15 show in elevation and side view respectively, two further embodiments, in which the printing products are taken up by grippers and conveyed away.

In the case of the apparatus represented in FIG. 14, the conveying device 10 is of an identical design to that of the apparatus according to FIGS. 1 to 5 and 12 and is therefore not described in any more detail. The removal conveyor 74 has a drawing member 76, which is indicated by dot-dashed lines, is revolvingly driven in conveying direction F and on which individually controllable grippers 78 are arranged one after the other at certain intervals. In the takeover region 14, the drawing member 76 is led around a deflection wheel, only represented by its rotary shaft 80. Each gripper 78 has two gripper jaws 82, which can be moved by means of an actuating lever 84 from an open position into a clamping position and back again. This can be performed, for example, by the actuating lever 84 being swiveled by means of rocker arms. The printing products 12 are conveyed in an imbricated formation S, in which again two printing products 12 in each case rest congruently one on top of the other on two succeeding printing products 12 lying one on top of the other, in conveying direction F toward the takeover region 14. The printing products 12 resting on the conveyor belts 22, 22' are precurved and conveyed with their leading edges 32 toward the stop 16. The respectively uppermost printing product 12', up against the stop 16 and precurved, is arched by means of the arching device 18, not represented in this figure. The grippers 78, brought to the takeover region 14 in their open position, embrace this arched printing product 12' with their gripper jaws 82 in the region of the arching of the leading edge 32. By actuation of the actuating lever 84, the gripper jaws 82 are first transferred into the clamping position, so that then each gripper 78 then holding a single printing product 12 conveys it away.

Figure 15:
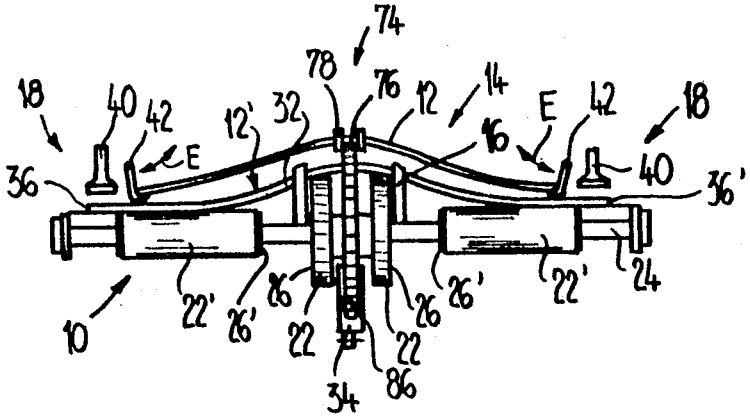

The apparatus according to FIG. 15, only represented in elevation, is of a similar design to the apparatus according to FIG. 14. On the shaft 24, arranged in the takeover region 14, of the conveying device 10 are mounted the two deflection rolls 26' for the two outer, lying conveyor belts 22' and, between these two, deflection rolls 26 for two conveyor belts 22 running parallel to each other. The diameter of the deflection rolls 26 is greater than the diameter of the deflection rolls 26'. Likewise seated on the shaft 24, between the two deflection rolls 26, is a deflection wheel 86 for a similar removal conveyor 74, as is represented in FIG. 14. The drawing member 76 is led around this deflection wheel 86 and likewise has individually controllable grippers 78 arranged one behind the other. In the region of the two side edges 36, 36' of the printing products 12 fed by means of the feed conveyor 10 there is provided in each case a raising element 40 and a slide element 42. The raising elements 40 are of the same design as in the apparatuses according to FIGS. 1 to 11. The slide elements 42 can each be swiveled in the direction of the double-headed arrow E about an axis running parallel to the conveying direction F.

The printing products 12 resting on the conveyor belts 22, 22' are conveyed with their leading edges 32 toward the stop 16, held in stop position by means of the cylinder-piston unit 34, and thereby precurved. The respectively uppermost printing product 12 up against the stop 16 is raised by means of the raising elements 40 in the region of the side edges 36, 36' and engaged underneath by the swiveled-apart slide elements 42 in the region of the side edges 36, 36'. By subsequent easing of the raising elements 40, they release the printing product 12', which is completely arched by subsequent swiveling toward each other of the slide elements 42. The printing product 12 thus arched in the central region is taken in the region of the leading edge 32 by a gripper 78 of the removal conveyor 74 and conveyed away. As soon as a gripper 78 has taken up the respective printing product 12, the slide elements 42 are swiveled apart, in order to take the next printing product 12' up against the stop 16 and to be raised by the raising elements 40 and to subsequently arch it.

A further embodiment of the arching device 18 is diagrammatically represented in FIG. 16. This likewise has a lateral stop element 38, a raising element 40 and a slide element 42. The raising element 40 is again designed as a suction member which can be connected to a vacuum source and can be raised and lowered in the direction of the double-headed arrow A. The slide element 42 can be swiveled in arrow direction G about an axis running essentially perpendicularly, and not represented. The printing products 12 are fed in conveying direction F to the takeover region 14 in an imbricated formation S, in which two printing products 12, lying congruently one on top of the other, in each case rest on the succeeding printing products 12. The printing products 12 come into contact with the stop 16 with their leading edges 32. The respectively uppermost printing product 12' up against the stop 16 is raised in the region of its left-hand side edge 36' and trailing edge 32' by means of the raising element 40 and is engaged underneath in the region of this side edge 36' by the slide elements 42. By clockwise swiveling of the slide element 42, the right-hand side edge 36, seen in conveying direction F, is pressed against the stop element 38 and the printing product 12' is arched, the arching in the region of the leading edge 32 as a consequence of the swiveling movement of the slide element 42 being greater than that in the region of the trailing edge 32'. The thus-arched printing products 12' can then be taken up in the region of the leading edge 32 by a removal conveyor 20 or 74 and conveyed away (compare FIGS. 1 to 7 and 14, 15).

A further embodiment of the arching device 18 is represented simplified in FIG. 17. This can be used in particular for the arching of thick printing products 12, such as for example newspapers or periodicals. Of the printing products 12 conveyed in conveying direction F with their leading edges 32 toward the stop 16 the respectively upper printing product 12' is taken up by the slide element 42 at its side edge 36' and pressed in direction B toward the other side edge, not represented in this figure. The slide element 42 has a tongue 88, which projects in the direction of the printing products 12, 12' and comes into contact on the upper side of the respective printing product 12' to be arched. It is ensured by means of this tongue 88 that the printing products 12, 12' which have not been forcibly precurved arch in the central region between the two side edges 36, 36'. Depending on whether this slide element 42 acts on the respective printing product 12' in the region of the leading edge 32 or in the region of the trailing edge 32', not represented in this figure, the said product is either arched in the region of the leading edge 32 or in the region of the trailing edge 32'.

The apparatus according to FIG. 18 likewise has a conveying device 10 designed as a belt conveyor. The printing products 12 rest on the conveyor belts 22 in an imbricated formation S, in which two printing products 12 lying congruently one on top of the other in each case rest on a pair of succeeding printing products 12. In the takeover region 14, the stop 16 is provided, toward which the printing products 12 are conveyed with their leading edges 32. The arching device 18, likewise provided in the takeover region 14, is of a similar design to the arching device represented in FIG. 16 and described further above. It has a stop element 38, likewise provided in the region of the right-hand side edges 36, seen in conveying direction F, of the printing products 12. In the region of the trailing edges 32' and of the left-hand side edges 36' of the printing products 12, 12' up against the stop 16 are provided the raising element 40 and slide element 42. The latter is mounted so as to swivel about an essentially perpendicularly running axis, the arching element 42 being able to swivel counter-clockwise for the arching of the printing product 12'. The removal conveyor 74 has individually controllable grippers 78, arranged one after the other on a revolvingly driven drawing member 76, represented in dot-dashed lines. The drawing member 76 is led from up to down and in conveying direction F toward the takeover region 14, deflected and taken away upward in conveying direction F', for example in guide rails or around deflection wheels, not represented. The individually controllable grippers 78 are of the same design and controllable in the same way as the grippers 78 according to FIGS. 14 and 15. The respectively uppermost printing product 12' up against the stop 16 is raised by means of the raising element 40 in the rear region of the left-hand side edge 36' and engaged underneath by the slide element 42. By counter-clockwise swivelling of this slide element 42, the printing product 12' is pressed with its right-hand side edge 36 toward the stop element 38 and arched in the central region of the trailing edge 32'. In the region of this arching, the printing product 12' is taken up by a gripper 78 and taken away in conveying direction F'.

Figure 19:
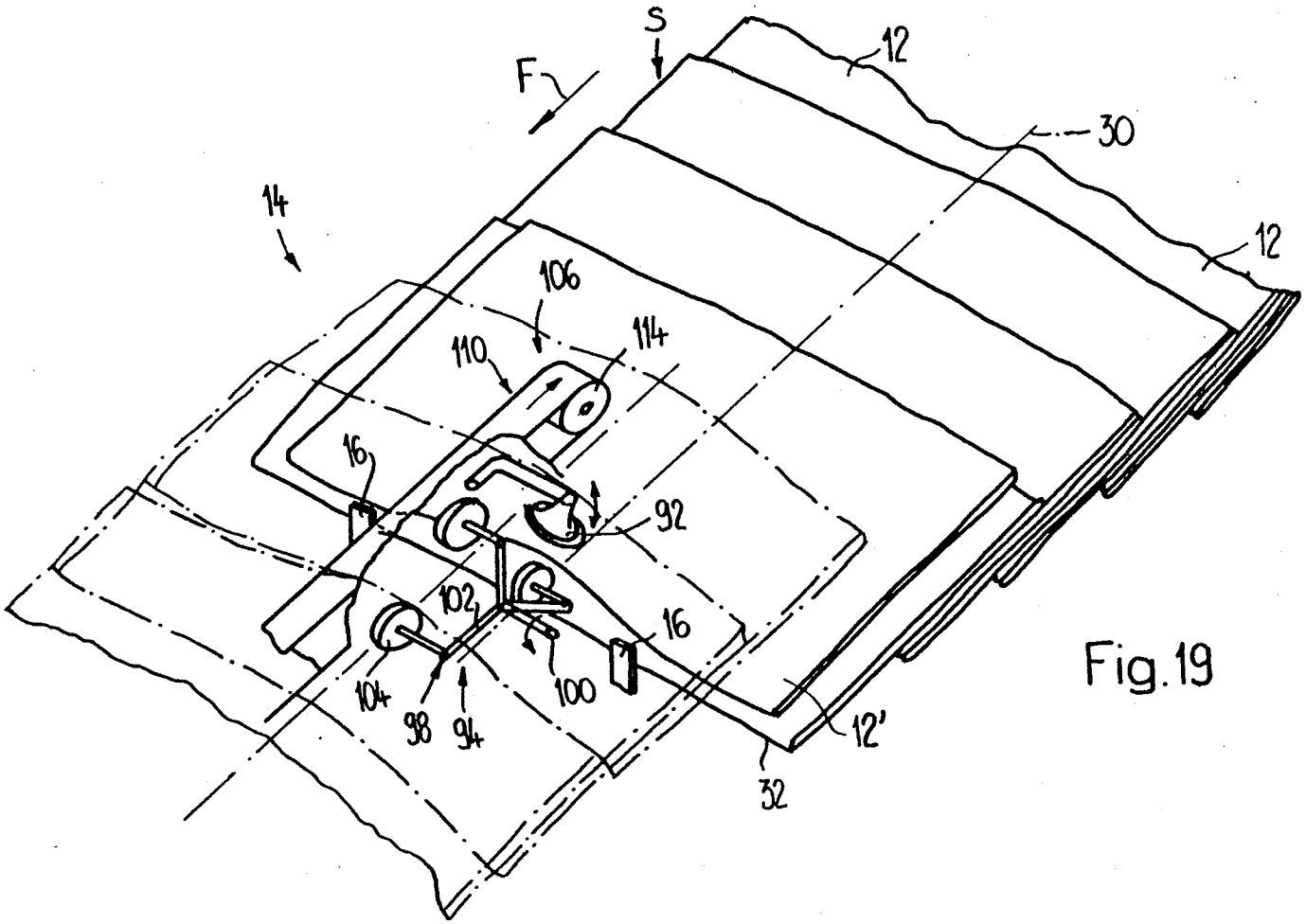
FIG. 19 shows a further embodiment of the apparatus, represented perspectively and simplified.
Figure 20:
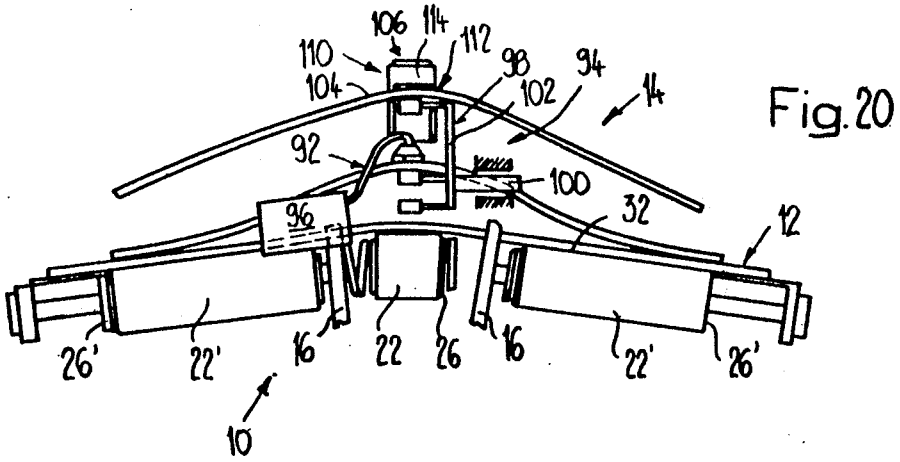
FIGS. 20 and 21 show the same embodiment as in FIG. 19, in side view and elevation, respectively.
Figure 21:
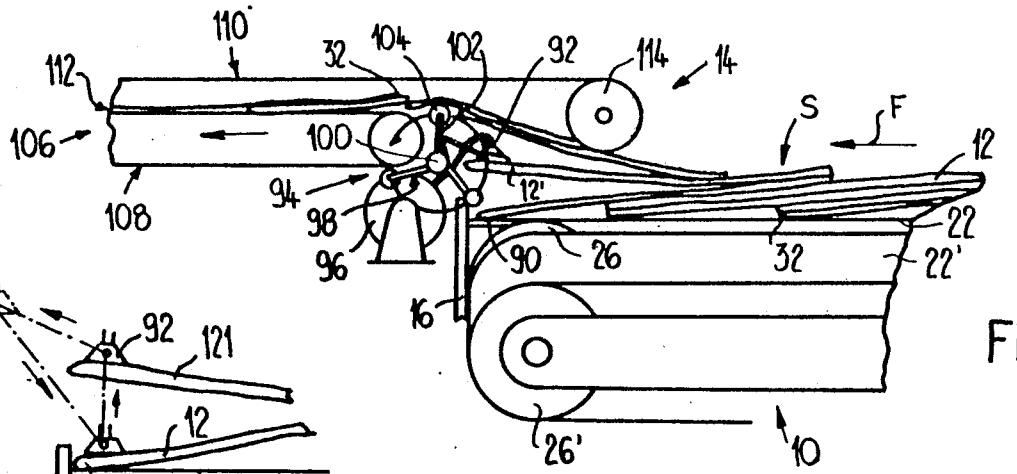
Figure 22:
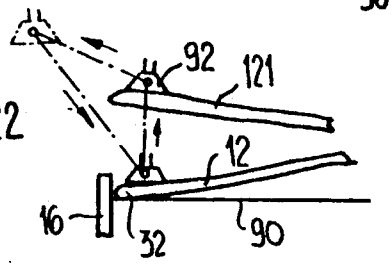
FIG. 22 shows a part of the suction head for the raising of the printing products.
Figure 2:
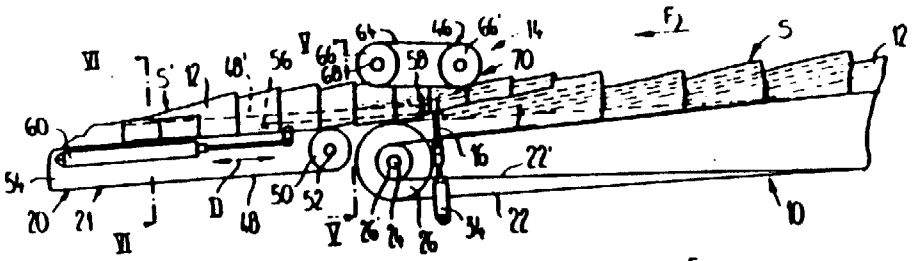
Figure 3:
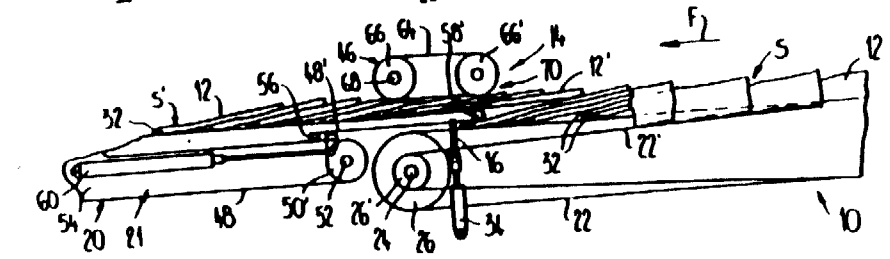
Figure 4:
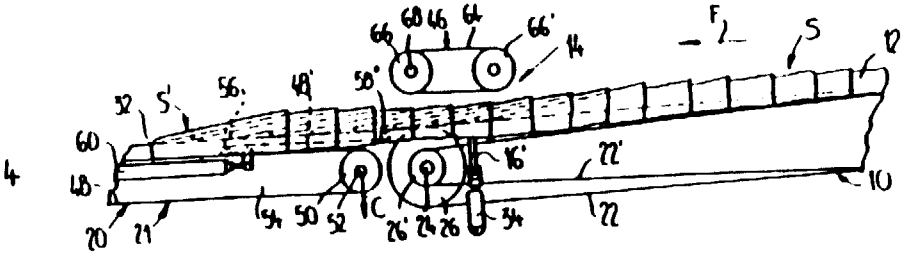

The apparatus represented in FIGS. 19 to 22 has a similar conveying device 10 as already known from FIG. 7. This has three conveyor belts 22, 22', which are revolvingly driven in conveying direction F and are led in a known way at the beginning and end of the conveying section around deflection rolls 26, 26', of which only those in the takeover region 14 provided at the end of the conveying section are represented. Seen in conveying direction F, the conveying surfaces of the lateral conveyor belts 22' extending downwardly towards the outsides in relation to the conveying surfaces of the central conveyor belt 22, so that the printing products 12 resting on these conveyor belts 22, 22' are precurved along the curving line 30 running in conveying direction F and in the region of the central conveyor belt 22 and represented by a dot-dashed line (FIG. 19). Seen in conveying direction F, downstream of the conveyor belts 22, 22' is the stop 16, which protrudes into the conveying path of the conveying device 10 from below in the form of a fork. As an extension of the central conveyor belts 22', a support plate 90 is provided, in order to divert the leading edges 32 of the printing products 12 running off the conveyor belts 22, 22' toward the stop 16 (FIGS. 21 and 22). The printing products 12 arranged on the conveyor belts 22, 22' of the conveying device 10 are provided in an imbricated formation S, in which two printing products 12 lying congruently one on top of the other in each case rest in an imbricated form on a pair of succeeding printing products 12.

In the takeover region 14, a lifting member 92 is provided for the raising of the uppermost printing products 12' respectively which are up against the stop 16 and an arching member 94 is provided for the finished forming of the arching on the raised printing product 12'. The lifting member 92 is designed in the manner of a suction bell and can be alternately connected to a vacuum source and have air admitted to it by means of a valve and drive arrangement 96 and can be moved in an approximately triangular path, as is diagrammatically represented in FIG. 22. Such a lifting member 92 and a corresponding valve and drive arrangement 96 are known from Swiss Patent Specification 626,589 and the corresponding U.S. Pat. No. 4,279,412. For the sake of better clarity, the valve and drive arrangement 96 is not represented in FIG. 19 and the printing products 12 to be conveyed away are indicated in dot-dashed lines and assumed to be transparent.

The arching member 94 has a three-armed star wheel 98, which is seated fixedly in terms of rotation on a rotary shaft 100 running in horizontal direction and at right angles to the conveying direction F. The rotary shaft 100, and thus the star wheel 98, are driven in such a way that the arms 102 of the star wheel 98 move during the course of rotation from down to up toward the fed printing products 12. At the free end of each arm 102 there is seated fixedly in terms of rotation a cylindical dog element 104, for example of hard rubber, the longitudinal axis of which runs parallel to the rotary shaft 100. Furthermore, the arching member 94 is arranged in such a way that in each a dog element 104 engages underneath the printing products 12' raised by means of the lifting member 92.

Downstream of the conveying device 10 is a removal conveyor 106, which has two belt conveyors 108, 110, which are arranged one above the other and define a common conveying nip 112. The beginning region of the lower belt conveyor 108 is provided where the dog elements 104 reach their highest point during the course of rotation of the star wheel 98. The deflection roller 114 provided in the beginning region of the upper belt conveyor 110 is arranged upstream, seen in conveying direction F, of the arching member 94, so that the lower, conveying side of this belt conveyor 108, covering the takeover region 14, runs from the deflection roll 114 via the lifting member 92 and arching member 94 away to the upper conveying side of the lower belt conveyor 108. Upon rotation of the star wheel 98, the dog elements 104 concerned in each case slightly raise the region of the conveying side of the upper belt conveyor 110 between the deflection roll 114 and the lower belt conveyor 108.

The apparatus represented in FIGS. 19 to 22 operates as follows:

The lifting member 92 is lowered onto the uppermost printing product 12' up against the stop 16, as indicated in dot-dashed lines and with the corresponding arrow in FIG. 22. The lifting member 92 is pressed against the printing product 12' resting on the support plate 90 in the region of the leading edges 32 of the said product and is connected to the vacuum source. Thereafter, the lifting member 92 is moved upward in the direction of the arrow by means of the valve and drive arrangement 96, which has the consequence that the printing product 12' taken up is lifted off the support plate 90 or off a further printing product 12 arranged on the latter. During the course of the rotation of the star wheel 98, a dog element 104 arranged on an arm 102 engages underneath the raised printing product 12' and takes it with it, while the lifting member 92 has air admitted to it by means of the valve and drive arrangement 96 and is removed in the direction of the arrow from the raised printing product 12'. Since the dog elements 104 are fastened fixedly in terms of rotation on the arms 102, the printing product 12' engaged underneath is raised further and taken along in conveying direction F, so that the said product comes into contact with its upper side against the underside of the preceding printing product 12 or with the conveying side of the upper belt conveyor 110. The printing product 12 thus clamped between the dog elements 104 and the preceding printing product 12 or the upper belt conveyor 110 is introduced by means of the dog element 104, with the leading edge 32 in front, into the conveying nip 112. Since the dog element 104 concerned in each case lifts off the conveying side of the upper belt conveyor 110 in the beginning region of the conveying nip 112, the conveying nip 112 widens in the beginning region in the form of a mouth, which makes it possible to introduce the leading edge 32 without any problem. While the one printing product 12 is introduced into the conveying nip 112, the next printing product 12' up against the stop 16 has already been raised by means of a lifting member 92, which is next engaged underneath by a further dog element 104 in an analogous way, as emerges in particular from FIG. 21. During the individual arching of the printing products 12 jointly coming into contact with the stop 16, the two next printing products 12, lying one on top of the other, are conveyed further toward the stop 16.

Of course, the conveying speeds of the conveying devices 10, 10' 10'' and removal conveyors 10, 74, 106 and the operating speed of the arching device 18 and of the lifting member 92 and arching member 94 are coordinated in such a way in relation to the frequency of the fed printing products 12 and of the formation S' to be formed and carried away that always a single printing product 12' up against the stop 16 is arched and taken up by the removal conveyor 20, 74, 106 or fed to the latter.

It is, of course, conceivable that, in a fed imbricated formation, more than two printing products lie congruently one on top of the other. It is also conceivable, however, that the printing products are fed to the takeover region in mutually spaced packs of in each case several printing products lying one top of the other. These packs are then preferably spaced so far apart on the conveying device 10 that they do not rest on the printing products up against the stop 16 before the lowermost printing product of the preceding pack is arched.

It is also conceivable that, in the case of an apparatus according to FIGS. 19 to 22, the entire arching of the printing products 12' can be performed by means of a suction bell. In this case, the removal conveyor is preferably designed in such a way as is represented in FIGS. 1 to 15 and 18. It is also possible that the printing products are not arched in the central region of the leading or trailing edge but that the arching is performed in the region of the side edges.

Furthermore, an arching device is conceivable which only has a raising element, by means of which the printing product concerned is raised and pressed with the raised side edge in the direction of the other side edge. In the case of folded printing products, the arching is preferably performed in the region of the fold, since in this region the sections of the printing product cannot become detached from one another.

It would also be conceivable for the raising element to be designed so as to swivel, in order to arch the respectively raised printing product 12' by swiveling about a preferably horizontal axis.

By increasing the conveying speed of the removal conveyor, the printing products can be conveyed away individually, without mutual overlapping.

The apparatus according to the invention can also be employed as a so-called cycle generator, in order to convey further the fed printing products in a certain cycle sequence.

It is also conceivable, for example by means of a valve, to stop the connection between the raising element 40 or the lifting element 92, designed as a suction bell, and the vacuum source, during one operating cycle or more than one operating cycle, but with the raising element 40 or the lifting element 92 continuing its movement. In this case, during this operating cycle or during these operating cycles, the uppermost printing product 12' up against the stop 16 is not arched and conveyed away.

In the case of an embodiment of the arching device according to FIGS. 19 to 22, the fed printing products 12 can, for example, be precurved downward in the form of a V. This can have the effect in an upward arching of a printing product 12' of preventing the succeeding printing product 12 from being taken along, for example due to adhesion.

We claim:

1. In a process for conveying a succession of printing products wherein the products are moved continuously and successively in a conveying direction to a takeover region and wherein, at the takeover region, the products are transferred to a removal conveyor for further movement in succession; the improvement comprising, in the takeover region, arresting the products successively against a stop, while arrested, forming each successive product individually into an arched configuration as viewed perpendicularly to the conveying direction and transferring each product successively and individually to the removal conveyor in the arched configuration.

2. The improvement defined in claim 1 wherein the products arriving at the takeover region are arranged in congruent pairs one atop another and wherein, after being arrested by the stop, said one product of a pair is formed into the arched formation and transferred to the removal conveyor, and then said other product of the pair is formed into the arched formation and transferred to the removal conveyor.

3. The improvement defined in claim 1 further including the step of precurving the products towards said arched configuration prior to arresting the products against the stop.

4. The improvement defined in claim 1 wherein the respective products are formed into the arched configuration by moving one side edge of a respective product towards an opposite side edge of the product.

5. The improvement defined in claim 4 wherein said one side edge is swivelled while being moved towards the opposite side edge.

6. The improvement defined in claim 1 wherein the respective products are formed into the arched configuration by raising one side edge of a respective product and moving said side edge of the product toward an opposite side edge thereof.

7. The improvement defined in claim 1 wherein the respective products are formed into the arched configuration by raising the opposite edges of a respective product and moving said side edges towards one another.

8. The improvement defined in claim 1 wherein the respective products are formed into the arched configuration by lifting a central region of each product.

9. The improvement defined in claim 8 wherein the central region of each product is lifted from above and from below.

10. The improvement defined in claim 9 wherein the central region of each product is lifted from above by suction and from below by mechanical means.

11. The improvement defined in claim 1 wherein the products are moved to the takeover region in a first imbricated formation with leading edge portions of respective products underlying preceding products.

12. The improvement defined in claim 11 wherein the products are conveyed away on the removal conveyor in a second imbricated formation.

13. The improvement defined in claim 12 wherein, in the second imbricated formation, the leading edge portion of a respective product underlies a preceding product.

14. The improvement defined in claim 11 wherein the first imbricated formation comprises congruent pairs of the products disposed one atop another in fully overlapping relation.

15. The improvement defined in claim 11 wherein the first imbricated formation comprises an imbricated buffer stack in which leading edge portions of respective products are overlapped to a degree by the respective preceding products.

16. The improvement defined in claim 15 wherein the products are conveyed away on the removal conveyor in a second imbricated formation and wherein said degree of overlap between adjacent products is reduced in the second imbricated formation.

17. In an apparatus for continuously conveying a succession of printing products comprising a feed conveyor for moving the products successively into a takeover region in a conveying direction, and a removal conveyor for receiving the products at the takeover region and successively moving the products from the takeover region; the improvements comprising a stop in the takeover region for arresting the successive products, arching means in the takeover region for forming the successive products when arrested by the stop individually into an arched configuration as viewed perpendicularly to the conveying direction and transfer means associated with the removal conveyor for removing the products successively and individually from the arching means.

18. The improvement as defined in claim 17 which further comprises precurving means for moving the products towards said arched configuration prior to the products being arrested by the stop.

19. The improvement as defined in claim 18 wherein the feed conveyor includes a central conveyor band and outer conveyor bands and wherein the precurving means comprises product support surfaces of the outer bands which diverge from a product support surface of the central band as the bands approach said stop.

20. The improvement as defined in claim 18 wherein the feed conveyor comprises plural laterally spaced conveyor bands having product support surfaces which diverge towards said stop to form said precurving means.

21. The improvement defined in claim 17 wherein the arching means includes at least one slide element moveably laterally with respect to the feed conveyor for engaging one side edge of a respective product and moving same toward an opposite side edge of the product.

22. The improvement defined in claim 21 wherein the arching means further includes a fixed abutment for engaging said opposite side edge of the product.

23. The improvement defined in claim 22 wherein the arching means further includes a lifting element for lifting the product along said one side edge to a level for engagement by said slide element.

24. The improvement defined in claim 21 including means for swivelling the slide element about a substantially vertical axis.

25. The improvement as defined in claim 17 wherein the arching means comprises opposed slide members moveable toward one another laterally of the feed conveyor for engaging opposite side edges of the respective products and moving said edges toward one another.

26. The improvement defined in claim 25 wherein the arching means further includes lifting elements for lifting the product at the opposite side edges to a level for engagement by the respective slide members.

27. The improvement as defined in claim 17 wherein the arching means comprises lifting means for raising a central region of a respective product.

28. The improvement defined in claim 27 wherein the lifting means includes a mechanical lifter for engaging and raising the central region from below.

29. The improvement defined in claim 28 wherein the lifter comprises a rotary star wheel.

30. The improvement defined in claim 28 wherein the removal conveyor comprises a belt conveyor and a pressing means with a nip for receiving the product defined therebetween and wherein said lifter is configured for transferring respective products in the arched configuration into said nip.

31. The improvement defined in claim 27 wherein the lifting means includes suction means for lifting the central region from above.

32. The improvement defined in claim 27 wherein the removal conveyor comprises a belt conveyor and a pressing means with a nip for receiving the products defined therebetween and wherein the belt conveyor has a telescopically extendable and retractable inlet end portion for transferring the products from the arching means into said nip.

33. The improvement defined in claim 17 wherein the removal conveyor includes a succession of individually controllable gripper means for releasably gripping the succeeding products at one of a leading and a trailing edge of a respective product after the product has been formed into the arched configuration.

* * * * *

UNITED STATES PATENT AND TRADEMARK OFFICE

CERTIFICATE OF CORRECTION

PATENT NO. : 5,042,792

DATED : August 27, 1991

INVENTOR(S) : Werner Honegger et al.

It is certified that error appears in the above-indentified patent and that said Letters Patent is hereby corrected as shown below:

In the Drawings, delete Drawing Sheet 2 and substitute therefor the Drawing Sheet, consisting of Figures 2-4, as shown on the attached page.

Signed and Sealed this

Nineteenth Day of October, 1993

Bruce Lehman

*Attest:*

BRUCE LEHMAN

*Attesting Officer*

*Commissioner of Patents and Trademarks*